US006672086B2

(12) United States Patent
Zangari et al.

(10) Patent No.: US 6,672,086 B2
(45) Date of Patent: Jan. 6, 2004

(54) FROSTING COOLER

(75) Inventors: Jony M. Zangari, Londrina (BR); Eduardo Nicolai, Londrina (BR); Marco Antonio Tadeu Ribeiro, Londrina (BR); Graziela Bertoni, Londrina (BR); André Elio Rohloff, Londrina (BR)

(73) Assignee: Hussmann Corporation, Bridgeton, MO (US)

( * ) Notice: Subject to any disclaimer, the term of this patent is extended or adjusted under 35 U.S.C. 154(b) by 0 days.

(21) Appl. No.: 10/190,937

(22) Filed: Jul. 8, 2002

(65) Prior Publication Data

US 2003/0033822 A1 Feb. 20, 2003

Related U.S. Application Data

(60) Provisional application No. 60/311,164, filed on Aug. 9, 2001.

(30) Foreign Application Priority Data

Jul. 6, 2001 (MX) ..... 006916

(51) Int. Cl.[7] ..... F28D 3/00; F25D 2/06

(52) U.S. Cl. ..... 62/156; 62/171

(58) Field of Search ..... 62/156, 171, 247, 62/314, 332, 376, 457.4

(56) References Cited

U.S. PATENT DOCUMENTS

| | | | | |
|---|---|---|---|---|
| 2,065,358 A | | 12/1936 | Zarotschenzeff | |
| 3,602,008 A | | 8/1971 | Kelley | |
| 4,237,697 A | | 12/1980 | Cherbland | |
| 4,501,130 A | | 2/1985 | Izumi | |
| 4,543,801 A | | 10/1985 | Damiens | |
| 4,612,777 A | | 9/1986 | Noma et al. | |
| 4,735,134 A | | 4/1988 | Brouwer | |
| 4,923,258 A | | 5/1990 | Styles | |
| 5,148,682 A | | 9/1992 | Wolf | |
| 5,327,738 A | | 7/1994 | Morioka et al. | |
| 5,367,887 A | | 11/1994 | Byrd et al. | |
| 5,417,080 A | | 5/1995 | Bishop | |
| 5,488,834 A | | 2/1996 | Schwarz | |
| 6,003,326 A | | 12/1999 | Hensley | |
| 6,205,800 B1 | * | 3/2001 | Topper et al. | 621/156 |
| 6,298,673 B1 | * | 10/2001 | Fung et al. | 62/82 |
| 6,314,751 B1 | | 11/2001 | Gjersvik | |
| 6,343,483 B1 | | 2/2002 | Armstrong | |
| 6,345,511 B1 | | 2/2002 | Esty et al. | |
| 6,363,733 B1 | | 4/2002 | Galembeck | |
| 6,601,396 B2 | * | 8/2003 | Bair et al. | 62/155 |

* cited by examiner

*Primary Examiner*—Melvin Jones
(74) *Attorney, Agent, or Firm*—Michael Best & Friedrich LLP

(57) ABSTRACT

A frosting cooler creates and maintains frost on cold products, such as bottles of a beverage stored in the cooler, thereby to provide a visual manifestation of the cold condition of the beverage. The cooler has the ability to deliver moisture to the products within the cooler so that frosting may be produced in environments where there is low humidity in the ambient air without freezing the liquid contained by the bottle. The cooler is operated to control to protect the frost on the products, once formed. In addition, the cooler is controlled to prevent frost build up on an evaporator and fan of the cooler in the presence of the additional moisture.

27 Claims, 11 Drawing Sheets

FROSTING COOLER

BACKGROUND OF THE INVENTION

This invention relates generally to refrigeration and more specifically to a cooler which creates and maintains frost on articles cooled thereby, particularly in conditions where there is low moisture content in the ambient air.

Articles which must be or are most preferably kept cold, such as containers of a beverage, are frequently sold from a cooler directly accessible by the consumer. One example of such a beverage is beer, particularly as sold in glass bottles. These coolers may appear in the refrigeration isle of a supermarket or other store, or elsewhere as a point of sale display. Merchandising refrigerated articles in the summer or in locations where the weather is hot is significantly aided by conveying a consumer concept that the beverage is very cold. Conventionally, signage is used which conveys in words and/or illustrations that the products contained within are kept cold. However, such representations do not provide direct visualization to the consumer of the actual temperature of the containers.

One way providing the consumer with direct evidence that the temperature of the beverage within the container is cold, is the presence of frost on the exterior of the container. The existence of frost on the bottle immediately conveys to the consumer the concept that the product contained inside is kept cold. It is known to provide frosted glasses or other containers for receiving liquid. Generally, a wetted container is placed in an temperature controlled cooler environment where the temperature of the container is quickly dropped causing the moisture to freeze as ice on the exterior of the container. If the controlled ambient air has a sufficient moisture content, there will not be a problem in maintaining such ice or frost on the containers. However, in some situations where the ambient air has low moisture content, such as in dry or elevated regions, it is difficult to achieve or maintain the frost. Moreover, the presence of substantial moisture in the cooler can cause operating problems for the refrigeration equipment. Still further where the containers carry a liquid, it is necessary to achieve frosting without causing the liquid to freeze. Generally, for glass bottles containing beer, the exterior temperature of the bottle is maintained between about −4° C. and −7.5° C.

SUMMARY OF THE INVENTION

Among the several objects and features of the present invention may be noted the provision of a cooler which achieves and maintains a frost on articles held by the cooler; the provision of such a cooler which provides additional moisture to the interior of the cooler for condensing on the articles; the provision of such a cooler which maintains the frost on the articles during defrost of a cooling coil in the cooler; the provision of such a cooler which inhibits the circulation of warm air within an article holding zone; the provision of such a cooler which controls delivery of moist air to the article holding zone and maintains the cooler within a desired temperature operating range; the provision of such a cooler which inhibits icing of the cooling coil; the provision of such a cooler which voltage protects its components; and the provision of such a cooler which is self-contained.

Generally, a cooler of the present invention comprises an insulated cabinet defining a product zone for holding the articles to be cooled. A cooling coil constructed and arranged for receiving a coolant therethrough removes heat from the product zone in the cabinet and a fan circulates air over the cooling coil and through the product zone in the cabinet. A water vapor source in fluid communication with the product zone delivers water vapor to the zone for condensing on the articles as frost. A controller to control flow of coolant through the cooling coil, operation of the fan and operation of the water vapor source, is configured to automatically conduct a defrost mode of the cooling coil to melt any frost thereon, and to restart a cooling mode of the coil at termination of the defrost mode. The controller delays operation of the fan after restarting the cooling mode following defrost until the cooling coil has reached a preselected temperature so that the circulation of air temperature though the cabinet will not adversely affect frost on the articles.

In another aspect of the invention, a cooler for cooling articles and maintaining frost on the articles generally comprises a cabinet, cooling coil, fan, and water vapor source as set forth above. A controller is capable of controlling flow of coolant through the cooling coil, operation of the fan, and operation of the water vapor source to deliver water vapor into the cabinet for condensing on the articles as frost. The controller is configured to prevent operation of the water vapor source until after the product zone has been cooled to a pulldown temperature.

In a further aspect of the invention, a cooler for cooling articles and maintaining frost on the articles generally comprises, a cabinet having a product zone, cooling coil and fan as described above. A water vapor source in fluid communication with the product zone delivers water vapor to the product zone for condensing on the articles. The water vapor source comprises a heater for heating water to form a vapor and piping extending from the heater at least partially within the insulated wall of the cabinet and having an outlet opening into the product zone.

In still another aspect of the present invention, a cooler for cooling articles and maintaining frost on the articles generally comprises, a cabinet having a product zone, cooling coil and fan as described above. A water vapor source in fluid communication with the product zone for delivers water vapor to the product zone for condensing on the articles. The water vapor source comprises a heater for heating water to form a vapor and piping extending from the heater and having an outlet opening into the product zone. The outlet is located downstream from the cooling coil and fan within the flow of air circulated by the fan.

In another aspect of the present invention, a cooler for holding and cooling articles generally comprises a cabinet defining a cooled area in which articles can be held. A cooling coil is disposed for cooling the cooled area, and a fan circulates air over the cooling coil and through the cooled area. The cooler further includes a compressor for compressing refrigerant, a condenser for removing heat from compressed refrigerant, a control for controlling operation of the compressor, and a temperature sensor for detecting the temperature of the cooled area of the cabinet. A voltage sensor detects voltage of a power source to which the cooler can be connected. The control is configured to operate in a normal mode to turn on and off the compressor in response to the temperature of the cooled area detected by the temperature sensor and to operate in an override mode to prevent the compressor from being turned on when the voltage sensor detects that the voltage of the power source is below a predetermined minimum start voltage.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
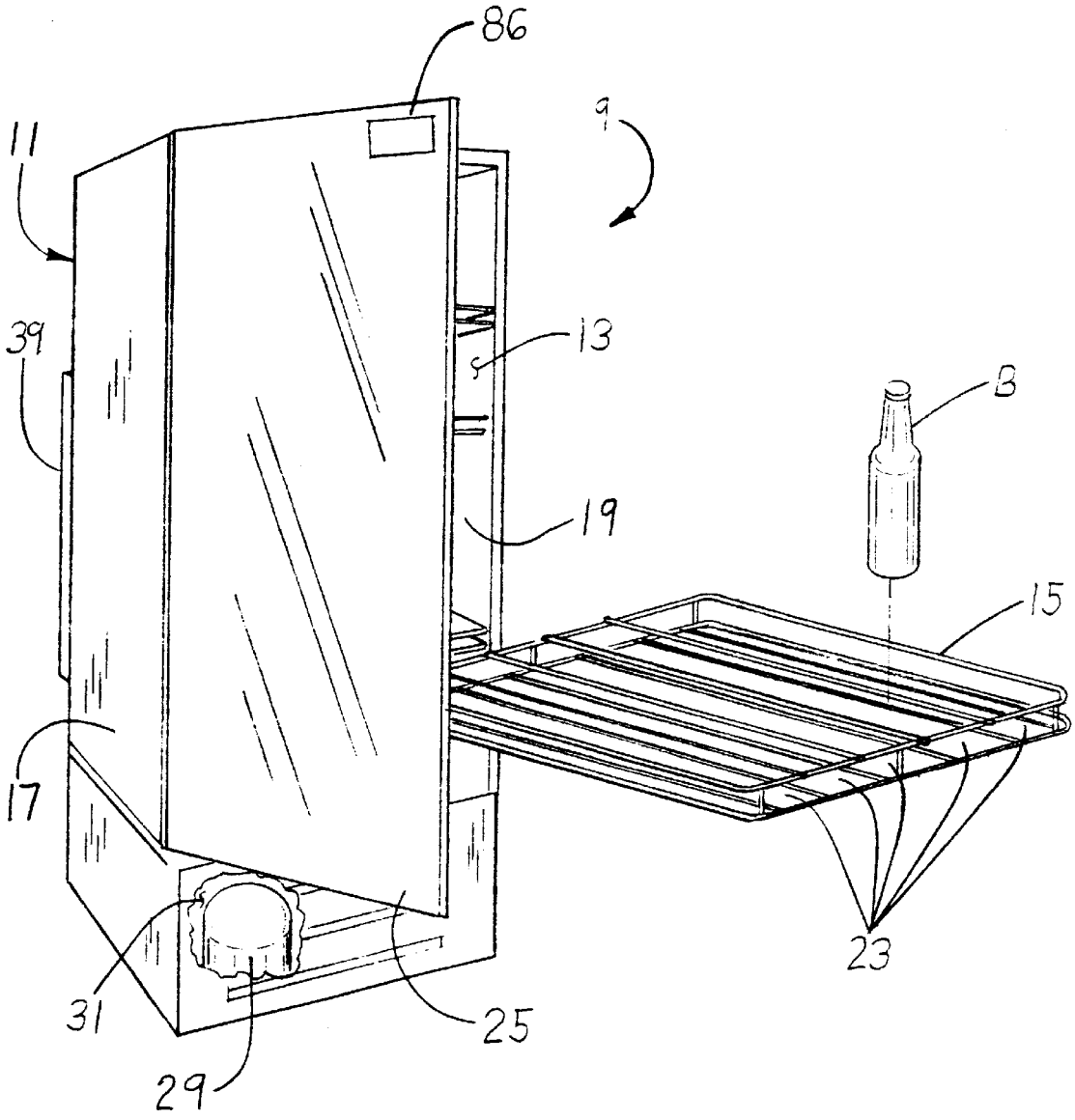
FIG. 1 is a perspective of a cooler of the present invention in the form of a merchandiser having a door in an open position with a product shelf (for holding bottles) exploded from the merchandiser.
Figure 3:
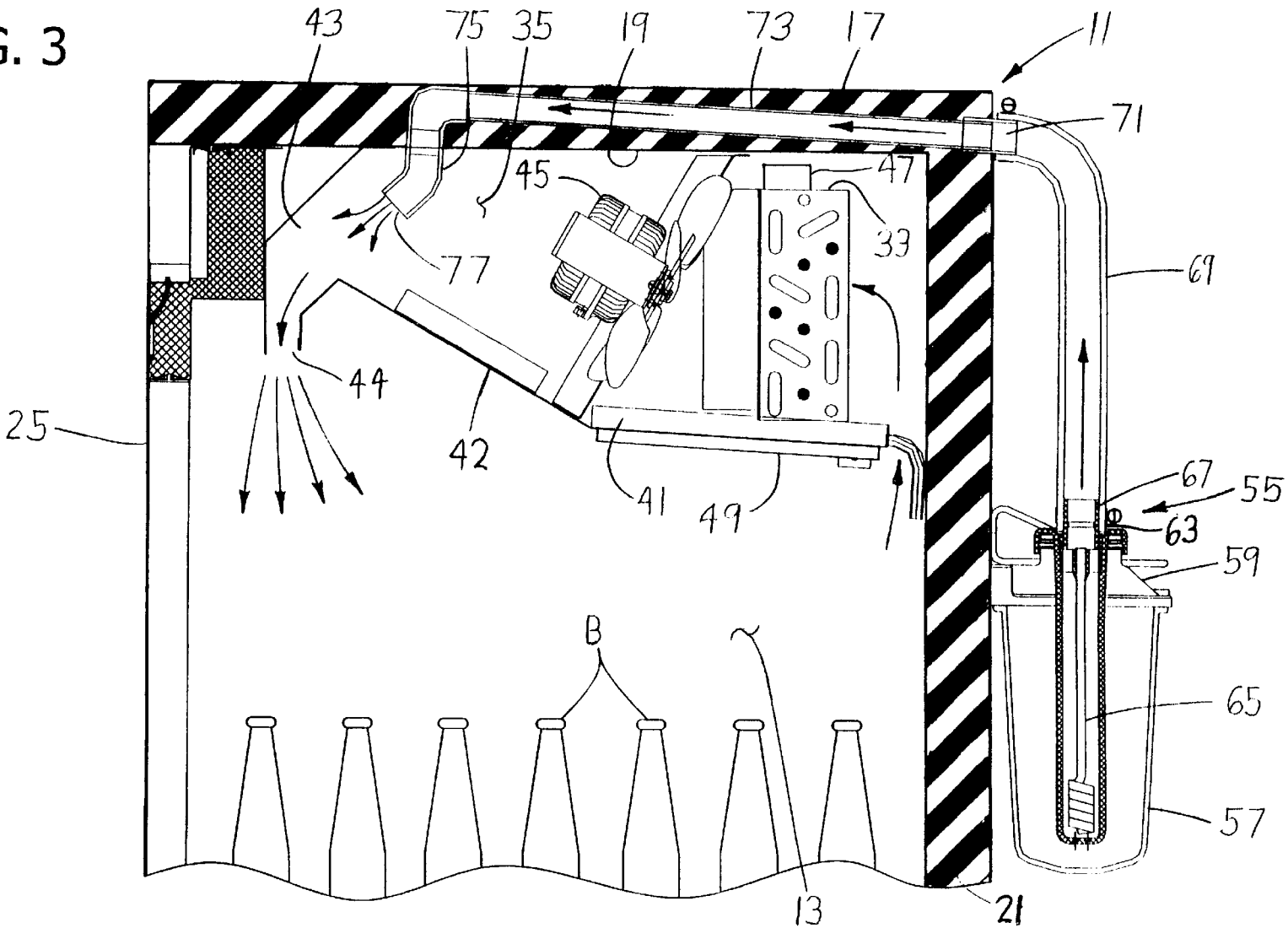
FIG. 3 is a schematic, fragmentary cross section of an upper portion of the merchandiser.

Referring now to the drawings, and in particular to FIG. 1, a frosted bottle merchandiser (broadly, "cooler") constructed according to the principles of the present invention is designated generally at 9. The merchandiser comprises a cabinet (generally indicated at 11) defining a substantially rectangular interior refrigerated product zone 13 and product mounting shelves 15 for holding articles containing a consumable liquid, such as bottles B of beer. The cabinet 11 includes an outer shell 17 and an inner shell 19, between which is located insulation 21 (FIG. 3). A representative one of the shelves 15 has been exploded from the cabinet 11 in FIG. 1 and has a wire frame construction including plural channels 23 for holding separate rows of bottles B extending in a front to back direction of the cabinet 11 to the thereby optimize air circulation through product zone 13. A door 25 pivotally mounted on the cabinet can be closed to seal off an open front of the cabinet, or opened to access the product zone 13 in the cabinet 11 to remove or load bottles B. Although in the preferred embodiment the invention is a merchandiser 9, it is not necessary for a cooler of the present invention to be of the type which is used in a display area of a supermarket or other store, or otherwise to be accessible by the end consumer. Moreover, the articles may be other than beverages or consumables of any type without departing from the scope of the present invention.

In the illustrated embodiment, the frosted bottle merchandiser 9 is self-contained, having a compressor 29 located in a lower compartment 31 of the cabinet 11, an evaporator 33 (FIG. 3) located in an upper compartment 35 above the product zone 13, and a condenser 39 mounted on the rear wall (FIG. 1) of the cabinet. As such, the merchandiser 9 can be connected to an electrical power source for operation without any other plumbing or electrical connection. The compressor 29 is piped together with the evaporator 33 (broadly, "cooling coil") and condenser 39 in a conventional vapor compression refrigeration circuit. The compressor 29 forces liquified refrigerant (broadly, "coolant") from the condenser 39, through an expansion valve or capillary tube (not shown) into the evaporator 33 where the refrigerant absorbs heat and is vaporized. The vaporized refrigerant returns to the compressor 29 where it is compressed to high pressure and temperature and delivered back to the condenser 39 where the rejection heat load is removed to the condensation temperature of the refrigerant. Other conventional vapor phase system components, such as a receiver (not shown), may be present. It is to be understood that the merchandiser 9 need not be self-contained, as either or both of the compressor 29 and condenser 39, and/or a control device may be located remotely from the cabinet 11. Moreover, it is envisioned that secondary cooling or other types of cooling (not shown) may also be used without departing from the scope of the present invention.

Figure 6:
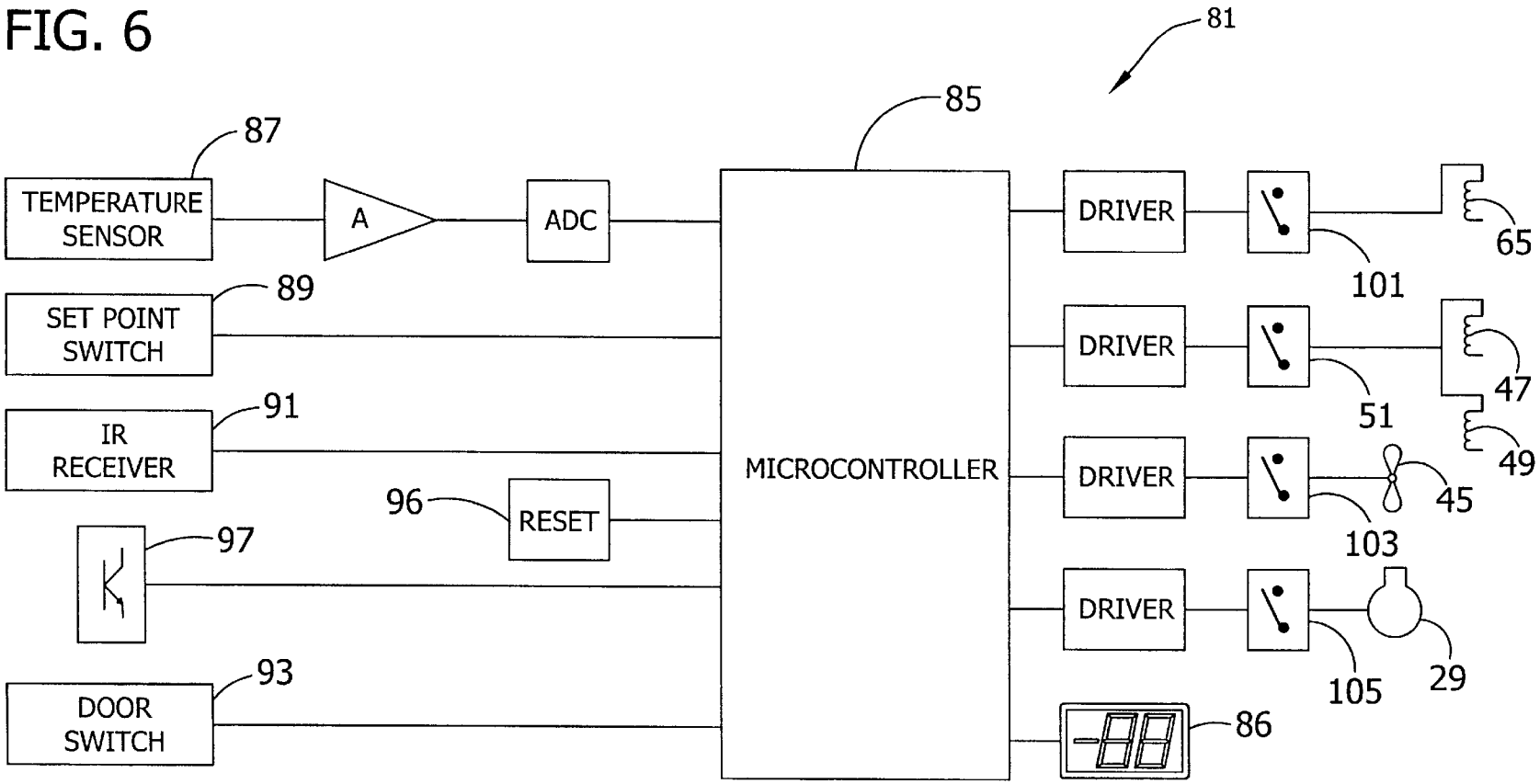
FIG. 6 is a schematic illustration of the controller.

As shown in FIG. 3, the evaporator 33 is positioned in the upper compartment 35 of the merchandiser 9 defined by upper, side and rear walls of the cabinet 11, a lower evaporator drip pan 41 and an angled duct member 42 defining a front plenum chamber 43 with a discharge opening 44. A fan 45 mounted in the upper compartment 35 of the cabinet 11 pulls air from the product zone 13 through a rear air opening behind the drip pan 41 and across the evaporator 33 for removing heat from the air. The cooled air passes through the fan 45 to the front discharge opening 44 where the cold air is discharged to circulate downwardly through the product zone 13 containing the bottles B. The discharge opening 44 preferably extends laterally of the cabinet 11 across the front above the product zone 13 and the flow of air is indicated generally by arrows in FIG. 3. It will be clear that other air control means may be used to promote even air distribution through the product zone 13. Thus it may be seen that air is circulated by the fan 45 through the cabinet 11 for evenly cooling the bottles B on all shelves 15 in the cabinet. A defrost heater 47 is provided for defrosting the evaporator 33 and a pan heater 49 is provided for heating the drip pan 41 to facilitate removal of frost from the evaporator coil and keeping the pan from becoming blocked with ice during defrost. In the illustrated embodiment, the heaters 47, 49 are controlled on the same circuit 51 (i.e., so both are simultaneously active or inactive, as shown in FIG. 6), but it is envisioned that they could be separately controlled. For example in one embodiment, the evaporator heater 47 is controlled by a microcontroller (described hereinafter) to be on, during a defrost cycle, while the drip pan heater 49 may be energized constantly. In another embodiment, an alternate form of defrost, such as hot gas, can be employed.

Figure 2:
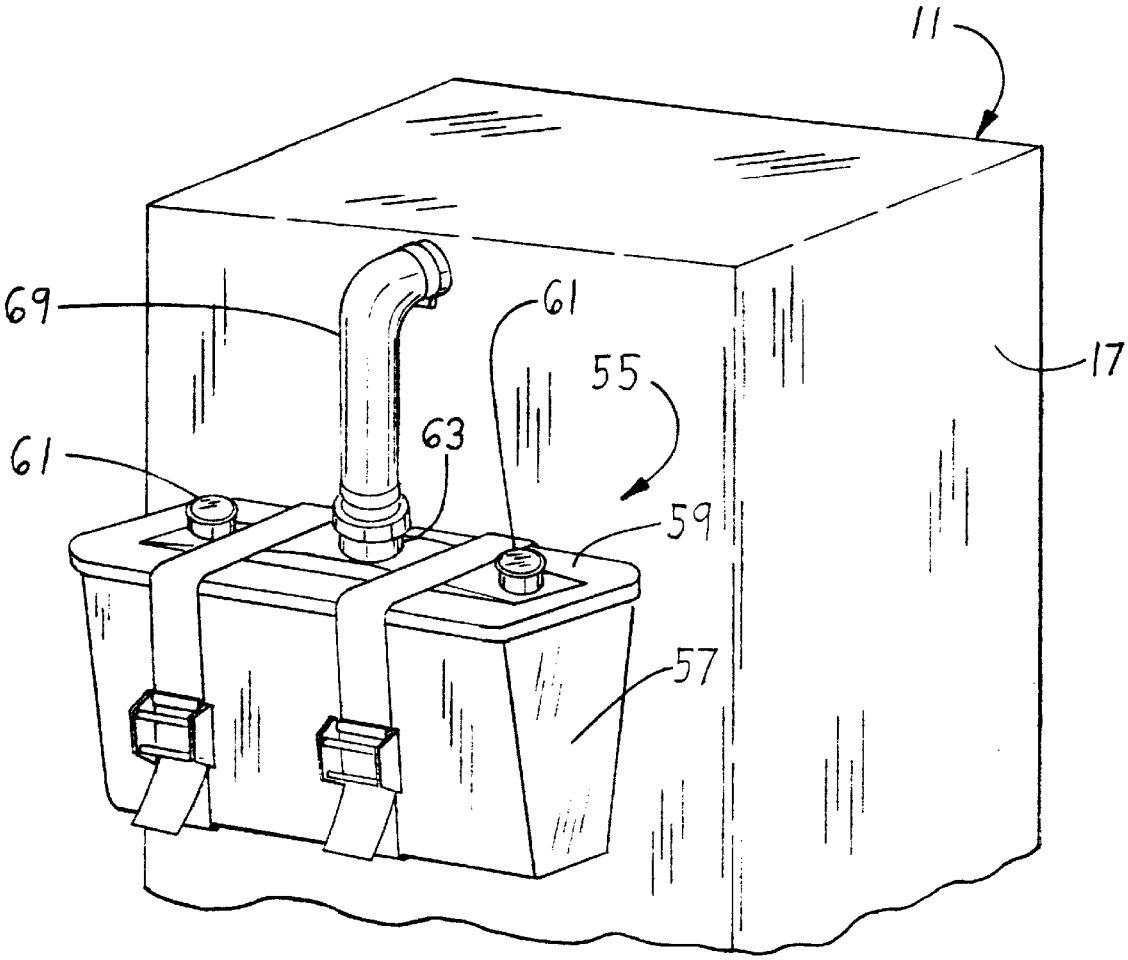
FIG. 2 is a fragmentary rear perspective of the merchandiser showing a water vapor delivery device.

The merchandiser 9 of the present invention is equipped with a water vapor source, indicated generally at 55, to generate moisture in the air inside the cabinet 11, as needed to form and maintain a coating of frost on the bottles B. As shown in FIG. 2, the water vapor source 55 comprises a reservoir tank 57 exteriorly mounted on the back side of the cabinet 11 for containing water. A lid 59 covering the open top of the tank 57 has a ports 61 for filling the tank. A central opening 63 in the lid 59 receives a submersible heater 65 into the tank 57 extending down into the water contained in the tank (FIG. 3). In the illustrated embodiment, the heater 65 is a 700W heater, but may be of a different power. When energized, the heater 65 heats up the water in the tank to percolate a constant water vapor at the top of the tank. A fitting 67 in the central opening 63 of the lid 59 connects a flexible hose 69 to the tank 57 and allows water vapor to pass out of the tank into the hose. The flexible hose 69 extends upward and bends to attach to another fitting 71 at the rear wall of the cabinet 11 for connection to a moisture distribution duct 73 located between the outer and inner shells 17, 19 of the cabinet 11 within the insulation 21. The insulation 21 helps to reduce heat loss and condensation within the duct 73. An outlet duct section 75, including an elongate outlet 77 extends downwardly into the upper cooling compartment 35. The duct section 73 is inclined to help keep any water condensate from dripping into the upper compartment 35 when the heater 65 is turned off.

The outlet 77 is located downstream from the evaporator 33 and fan 45, with respect to the direction of air flow through the upper compartment 35. The outlet 77 of the outlet section 75 is also angled toward the front of the merchandiser 9, away from the evaporator 33 and fan 45. By this arrangement moisture is entrained in the cold air circulated by the fan 45 and delivered throughout the product zone 13 and over the bottles B, where moisture is desired, before being recirculated back to the evaporator 33 and fan, where moisture is not desired. Thus, optimum moisture condensation on the bottles B is achieved before the air returns to the evaporator 33 and icing of the evaporator is significantly reduced to provide optimum effectiveness of the refrigeration system. In the illustrated embodiment, the moisture distribution system includes the flexible hose 69, straight duct section 73 and outlet section 75 collectively constitute "piping".

Figure 4:
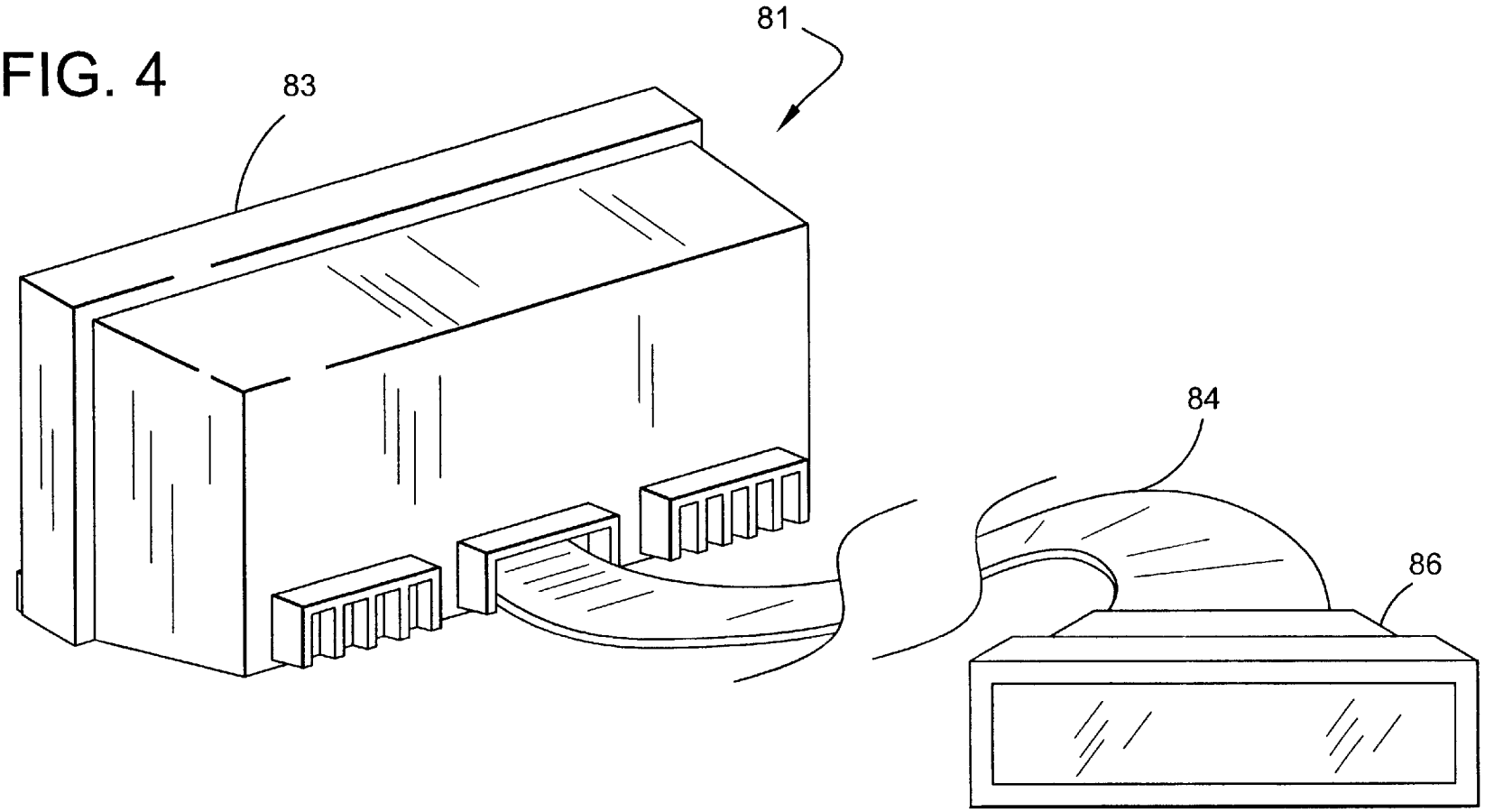
FIG. 4 is a perspective of a controller and LED display of the merchandiser.
Figure 5:
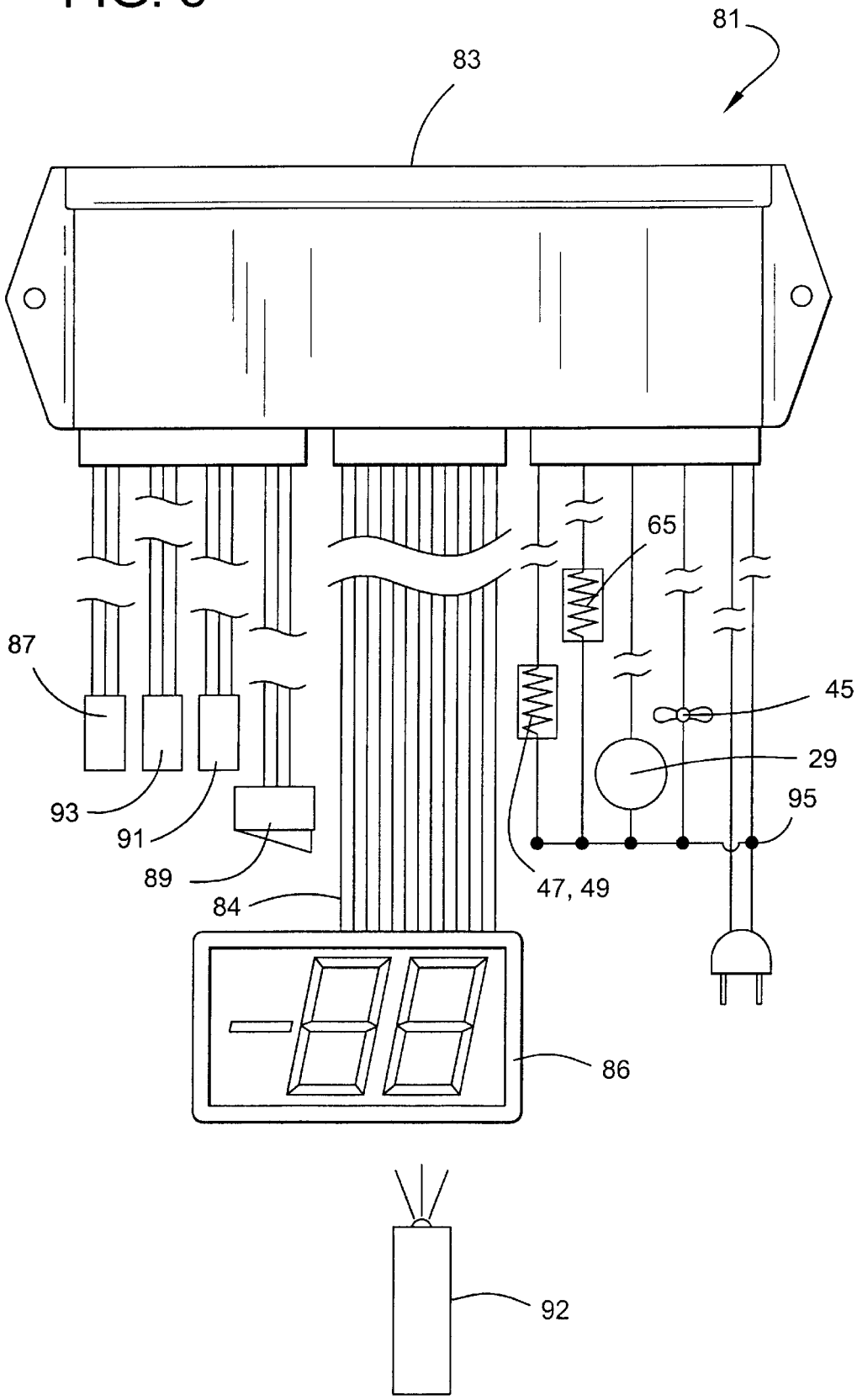
FIG. 5 is a diagrammatic plan view of the controller illustrating controller inputs and outputs.

Referring now to FIGS. 4–6, a controller of the merchandiser 9 indicated generally at 81 includes a housing 83 adapted for convenient mounting as on the door 25 of the merchandiser. The controller 81 comprises a microcontroller 85 connected by a ribbon cable 84 to an LED display 86 mounted in the cabinet 11 for viewing the internal temperature and other information, as will be described hereinafter. The microcontroller 85 includes a sensor input for receiving signals from a temperature sensor 87 positioned to detect the air temperature within the product zone 13 of the cabinet 11. A second input is connected to a set point switch 89 operable to select the air temperature set point for the product zone 13. In the illustrated embodiment, the merchandiser 9 can be set for −6° C. or −4° C. set point operation. The lower set point may be used in summer or hotter regions, while the higher set point is acceptable for winter or colder regions. A third input is attached to a infrared (IR) receiver 91 used to initiate or terminate defrost, as will be more fully described, by a command external of the microcontroller 85. The command may be given through a hand held IR control 92. A fourth input is connected to a door switch 93 which is opened or closed in correspondence with the position of the door 25. The controller 81 also has a connection for attachment to a power supply 95 (FIG. 5) powering operation of the controller and the LED display 86. The microcontroller 85 further includes outputs for independently controlling the evaporator and drip pan heaters 47, 49, the compressor 29, the fan 45 and the vapor generating heater 65.

Referring now to FIG. 6, is may be seen that the input from the temperature sensor 87 is amplified by an amplifier (A) and converted by an analog-to-digital converter (ADC) to a digital signal for manipulation by the microcontroller 85. A reset circuit 96 is operable to reset the microcontroller 85 as necessary. A voltmeter 97 is in electrical communication with the power source to which the merchandiser 9 is connected for reading the voltage of the power source for the reasons discussed hereinafter. Based on the various inputs, the microcontroller 85 is programmed to operate various control circuits, including the single defrost circuit 51 controlling both the evaporator heater 47 and the drip pan heater 49, through drivers. A steam circuit 101 operates the heater 65 of the water vapor source 55, a fan circuit 103 operates the fan 45 and a compressor circuit 105 operates the compressor 29. The door switch 93 is operable to cause the microcontroller 85 to open the fan circuit 103 to shut off the fan 45 when the door 25 is open.

Figure 7:
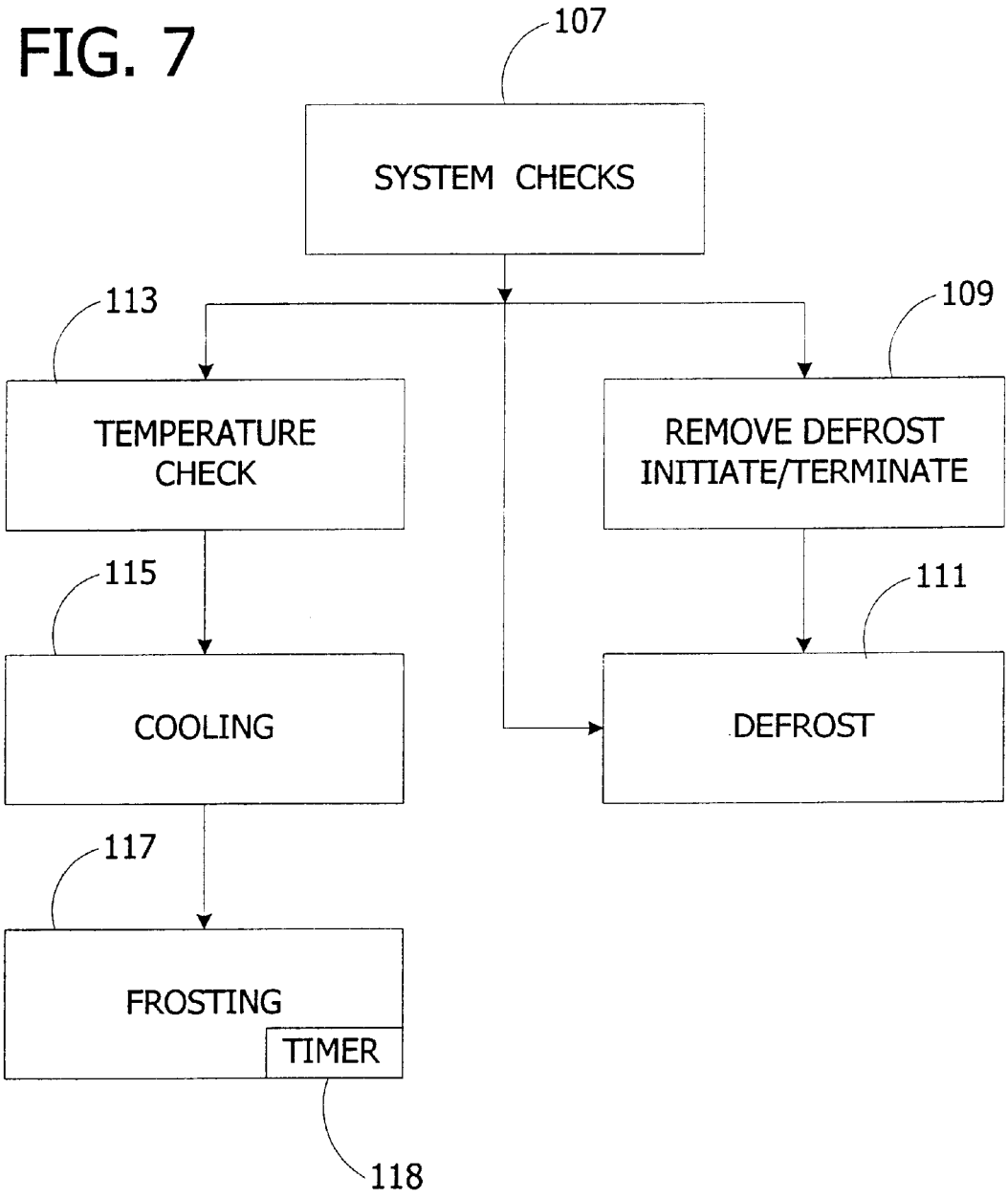
FIG. 7 is a flow chart illustrating general operation of the controller.

The operation of the controller 81, (i.e. microcontroller 85), and the merchandiser 9, is now described with reference to FIGS. 7 and 8A–8D. The general operation of the controller 81 is illustrated in FIG. 7 to include initially a system checks routine 107 in which parameters are initialized and operating conditions are checked. Certain steps of the system checks routine 107 are repeated throughout operation of the microcontroller program, as will be described, while others are not. The program proceeds from the system checks to any of three general operating functions (remote defrost initiate/terminate routine 109, defrost routine 111 or temperature check routine 113) depending upon the conditions. If the appropriate signal is received, the controller 81 can initiate defrost (i.e., cause the program to move to defrost routine 113) or terminate an ongoing defrost of the merchandiser 9 by way of remote defrost initiate/terminate routine 109. This is useful both to check operation upon initial installation of the merchandiser 9 and to diagnose problems or verify operation of the merchandiser at some later time. Assuming no special circumstance exists, the controller 81 proceeds to the temperature check routine 113 by comparing the temperature measured by the sensor 87 with the set point. If the temperature is within a bounded range of the set point, the controller 81 proceeds back to the system checks routine 107. Of course upon start up, the temperature of the product zone 13 is higher than the upper end of the set point range so that the controller 81 will first proceed to a cooling routine 115. The cooling routine will activate the compressor circuit 105 and the fan circuit 103, after certain delay periods have expired, to cool and circulate air through the product zone 13 of the merchandiser cabinet 11.

At certain predetermined times or under certain conditions specified hereinafter, the defrost routine 111 is carried out. Defrost is conducted until such time as the temperature of the product zone 13 measured by the sensor 87 exceeds a prescribed upper limit, or a defrost timer times out. An important feature of the present invention is that upon leaving defrost, the fan 45 is delayed after the compressor 29 begins to operate so that warm air will not be circulated through the product zone 13 to protect the frost formed on the bottles B. Also, the fan 45 is not run during defrost for the same reason. Further, defrost will be terminated if the temperature in the product zone 13 rises to a point which threatens the frost on the bottles B. The evaporator heater 47 and drip pan heater 49 are activated by closing the circuit 51 during defrost to heat the evaporator 33 and the drip pan 41.

Activation of the water vapor source 55 pursuant to a frosting routine 117 to provide moisture in the form of steam to the product zone 13 of the cabinet 11 occurs only after the product zone has been pulled down, that is, the temperature in the product zone measured by the sensor 87 has fallen below the lower end of the set point range so that the compressor 29 is shut off. In the illustrated embodiment, the range is ±1.5° C. from the set point (−4° C.), but other set points and ranges may be employed. Frosting will not be initiated by the frosting routine 117 unless the temperature measured in the case is below a certain predetermined minimum frosting initiation temperature. Further, frosting can be terminated after it is started if the measured temperature of the product zone 13 rises above a maximum frosting temperature, which is a temperature above the upper end of the set point range. If conditions for initiating frosting are satisfied, the controller 81 causes the heater 65 to be energized so long as the compressor 29 is running. A frosting timer 118 permits frosting to be carried out for a predetermined period of time (e.g., 40 minutes). Thereafter, frosting is not permitted to activate for another period of time (e.g., 40 minutes). Cycling of the frosting function in this manner assists in reducing icing of the evaporator 33 while maintaining frost on the bottles B.

Reference is made to FIGS. 8A–8D for a more specific understanding of the operation of the controller 81. When the merchandiser 9 is first installed or restarted, the microcontroller 85 begins the operating program with an initialize parameters function 121 setting the initial values of certain parameters used in the remainder of the program. The set point is retrieved as the last set point stored by the microcontroller 85, which may be for example −4° C. The microcontroller 85 is also placed in a cooling mode. Other parameters are set as follows:

| | |
|---|---|
| refrigeration cycle timer = 0 | compressor delay = 90 seconds |
| fan delay = 0 | pulldown = LOW |
| defrost timer = 0 | temperature protection −5° C. = ON |
| frosting timer = 0 | fan flag = HI |
| compressor flag = HI | |

The meaning of these parameters will be explained hereinafter. In the next step, the microcontroller 85 makes certain that all relays are open, i.e., so that the compressor 29, fan 45, evaporator and drip pan heaters 47, 49 and water vapor source heater are all inactive as the program begins. The program is now prepared to enter its main operating sections.

The system checks routine 107 includes features to protect the compressor 29 (and other electrically powered parts of the merchandiser which are controlled by the microcontroller 85) from starting if the voltage from the power source (e.g., utility power or a local generator) is not within specification. The microcontroller 85 receives a signal from the voltmeter 97 (see FIG. 6) which is representative of the voltage of the power source. At a voltage decision block 123 (FIG. 8A) the program compares the measured voltage with a minimum start voltage stored in the microcontroller 85. Examples of a minimum start voltage are 115 volts for a 127 volt standard power and 198 volts for 220 volt standard power. Of course, the minimum start voltages will depend upon the particular equipment being powered, and can be other than described without departing from the scope of the present invention. If the minimum acceptable start voltage is not present, the program enters a loop in which it will re-examine the measured power source voltage to determine if it is above the minimum start voltage. The program will not proceed until the minimum start voltage is detected so that the compressor 29 and other electrical components of the merchandiser 9 cannot be activated under conditions which could damage or materially reduce their life or maintenance cycle.

Once the minimum start voltage has been detected at block 123, the program proceeds to check for a change in the temperature set point. For example, and as stated above, the merchandiser may have two set points, −4° C. and −6° C. The set point may be changed by the user through the set point switch 89 in the merchandiser 9 (FIG. 6). In a set point change decision block 125, the program determines whether the switch has been changed from one position to the other since the last time the switch position was read. If the switch has been moved, the new set point is shown on the LED display 86 of the merchandiser 9. The temperature as measured by the temperature sensor 87 is read, and the microcontroller 85 checks at block 127 to determine if the sensor is operating. If not, the controller 81 causes the display 86 to show the alarm or malfunction symbol "99" on the LED display and the program loops back to open the relays, until such time as the presence of an operating sensor is detected. If the sensor 87 is functioning properly, the program of the microcontroller 85 proceeds to update the temperature shown on the LED display 86.

The remote defrost initiate/terminate routine 109 is available, upon detection of a IR signal from a remote control 92. The remote control can be an IR transmitter provided to a refrigeration installation and/or repair technician. Other types of remote controls, such as RF or hardwired Internet controls could also be used. If the signal is detected by the IR receiver 91, the microcontroller 85 first verifies at verification block 129 that the signal corresponds to a preset code to prevent inadvertent initiation or termination of the defrost cycle. If the signal does not satisfy the code (i.e. is not found to be a command signal at decision block 131), the program returns to its ordinary sequence of operation. However if the signal is verified, the microcontroller 85 will check the mode of operation at decision block 133, which has been initially set to cooling mode, as noted above. The mode will be changed to defrost mode so that in due course, the defrost routine 111 will be entered. However, in the event the mode of operation had already been changed to defrost mode (such as in the subsequent operation of the merchandiser 9), the mode would be changed back to cooling mode. Thus it may be seen that receipt of a signal from the remote control 92 is operable to initiate defrost or to terminate defrost, depending upon the present mode of operation of the microcontroller 85.

Figure 8A:
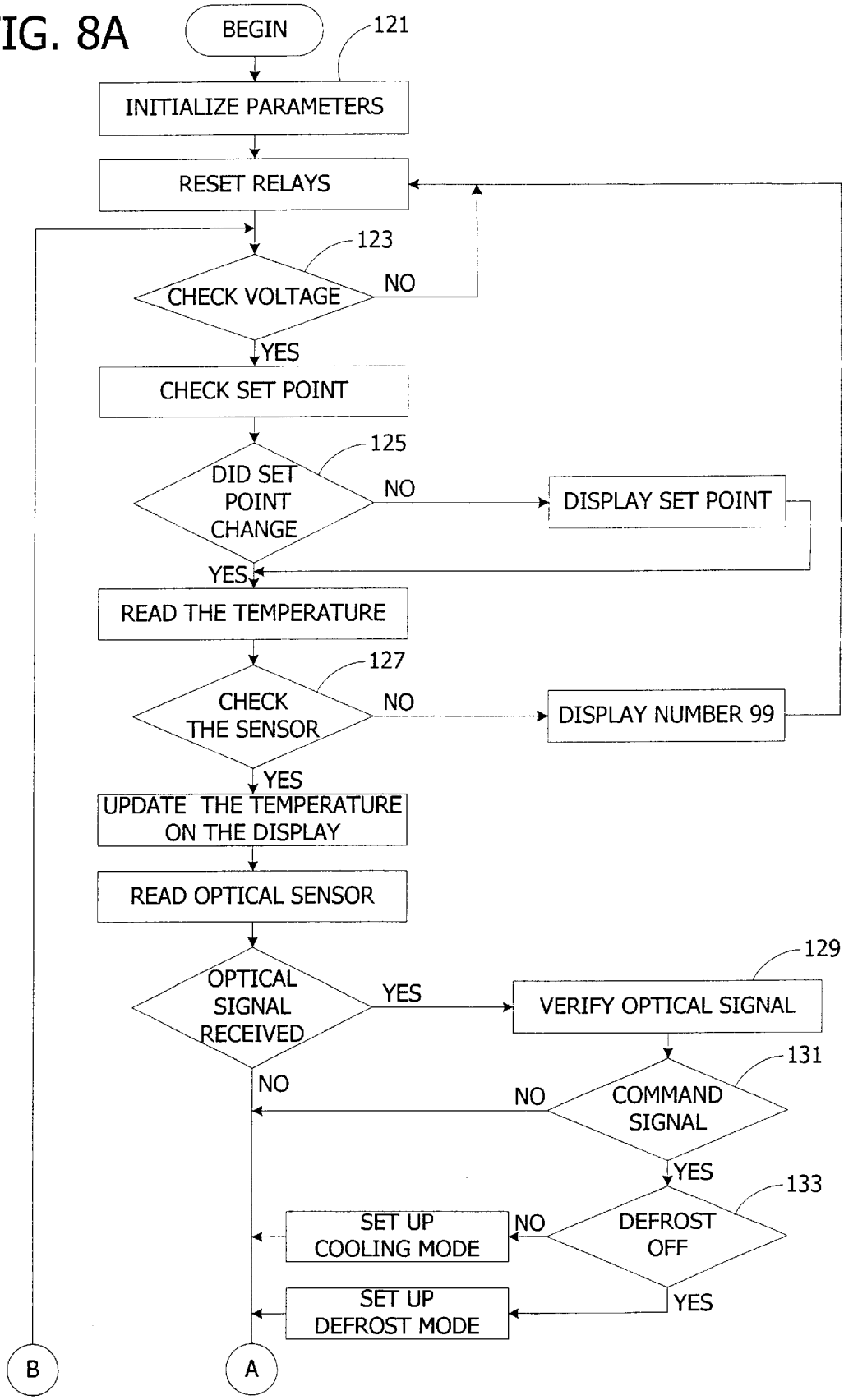
FIGS. 8A–8D are a more detailed flow chart of the operation of the controller.
Figure 8B:
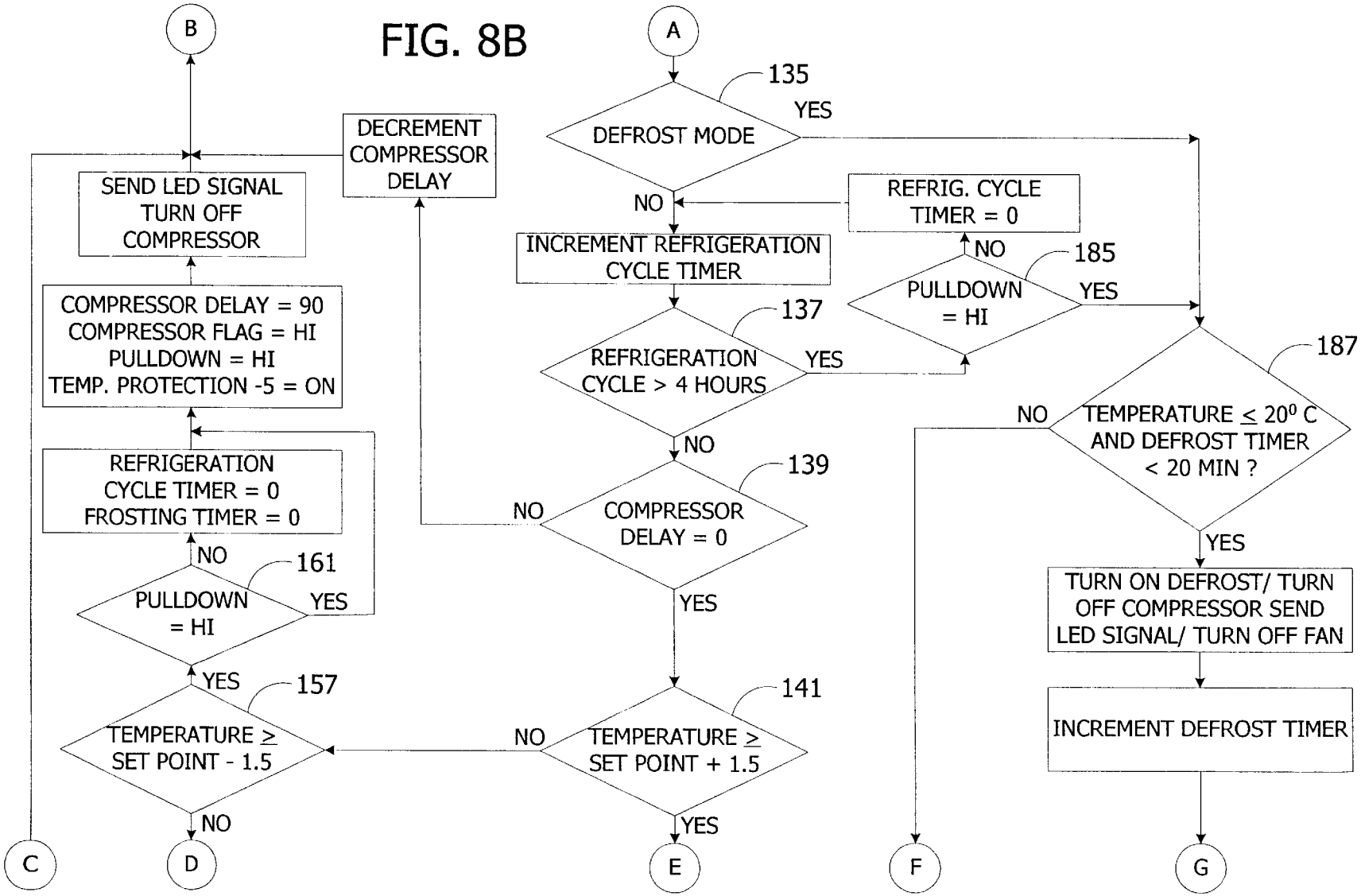

If no signal is received by the IR receiver, the program queries whether the microcontroller 85 is in the cooling mode or the defrost mode at decision block 135 (FIG. 8B). The microcontroller 85 was placed in the cooling mode when the parameters were initialized at block 121. Assuming no IR signal has been detected to change the mode to defrost, the program increments the refrigeration cycle timer. The next decision block 137 compares the value of the refrigeration cycle timer with the time allotted between initiation of defrost, which in the illustrated embodiment is four hours. Upon start-up of the merchandiser 9, four hours will not have passed, so the program continues on to inquire at block 139 if the compressor delay, which was initialized at 90 seconds, has counted down to zero. The answer will be no, so the program passes through a step of decrementing the compressor delay and then return to the systems checks routine 107 (more specifically, to voltage decision block 123). If the voltage falls below a preset minimum after operation of the compressor 29 has begun, the microcontroller 85 will shut down the compressor.

The program will loop back to the same decision block 139 until the compressor delay reaches zero. This will allow some time to make sure that the power source voltage is settled within specification before the compressor 29 can be energized. Eventually, the compressor delay reaches zero and the program proceeds to the temperature check routine 113. At the high end temperature range decision block 141, the microcontroller 85 compares the temperature of the product zone 13 measured by the sensor 87 against the set point plus 1.5° C. Where the set point is −4° C., the high end of the temperature range is −2.5° C. The temperature of the product zone 13 in the merchandiser 9 will be greater than −2.5° C. when the merchandiser is first plugged in so the program will leave the temperature check routine 113 and continue on at "E" (FIG. 8C) in the cooling routine 113 at function block 143 to turn on the compressor 29. In the same block 143, the microcontroller 85 causes a portion of the LED display 86 to flash, which indicates that the compressor 29 is running. The compressor flag is also reset from its initial value to LOW. The program then checks the fan delay at block 145, the significance of which will be explained hereinafter in the context of pull down after defrost. However, as an initial matter the fan flag has been set to HI (i.e., "high") so the program turns on the fan 45 at function block 147.

The frosting routine 117 will not be implemented at this early stage. Although the frosting timer 118 is incremented at block 149, when the program reaches a temperature protection decision block 151 (FIG. 8D) it will proceed to reset the frosting timer to zero (block 153) because the temperature of the product zone 13 in the merchandiser 9 will not have fallen to −5° C. However even if the measured temperature in the product zone 13 is less than −5° C., the frosting routine 117 will not be entered because the product zone has not been pulled down to the lowest end of its temperature range (i.e., −5.5° C.). In other words, unless the compressor 29 has been shut off once, frosting cannot be initiated. The parameter pulldown was initially set to LOW (meaning pulldown not yet achieved) which prevents the onset of frosting at decision block 155. Under either circumstance, the program proceeds from the frosting timer reset block 153 via "B" which returns the program to the system checks routine 107 (block 123).

The program will follow the same steps until such time as the temperature of the product zone 13 is reduced to −2.5° C. (or below). The program will proceed from block 141 (FIG. 8B) to a low end temperature range decision block 157 where the measured temperature is compared with the low end of the range (i.e., −5.5° C.). Assuming for purposes of this description that the merchandiser 9 has just been activated, the temperature will be less than −2.5° C. and greater than −5.5° C. for some time, so the program will proceed at "D" back to the cooling routine 115. The compressor flag has been set to LOW so the answer at decision block 159 (FIG. 8C) is "no" and the program keeps the compressor 29 and fan 45 operating to continue cooling the product zone 13. Again the frosting routine 117 will not be entered because either the temperature will not be less than −5° C. (FIG. 8D, block 151), or because the pulldown flag continues to be LOW (block 155) because the compressor 29 has yet to shut off one time.

Assuming normal operation of the merchandiser 9, the temperature in the product zone 13 will eventually fall below −5.5° C. so that the answer at the low temperature end range decision block 157 will be "yes" (FIG. 8B). The pulldown flag is still set to LOW so the program proceeds from decision block 161 to reset the refrigeration cycle timer and the frosting timer to zero. Immediately following, the pulldown flag is reset to HI, because the merchandiser 9 has achieved refrigeration pulldown of the product zone 13. Additionally, the compressor 29 is turned off and the compressor flag is set to HI. The compressor delay is reset to 90 seconds (preventing short cycling), and the portion of the LED display 86 stops flashing. The temperature protection −5° C. is turned on. The program once again returns to the system checks routine 107 and proceeds in a loop (at block 139) until the compressor delay times out. After the delay has expired, the program proceeds to the temperature check routine 113. If the temperature remains below the low end of the set point range (i.e., below −5.5° C.) the program cycles back to the system checks routine 107 at "B". However, because pulldown has been achieved and the pulldown flag is set to HI, the refrigeration cycle timer and frosting timer will not be reset to zero. It is noted that the frosting timer will not have been incremented during the period of the compressor delay.

The product zone 13 will warm up due to inherent product heat loads, and ambient conditions around the merchandiser, i.e. as heat exchange from the bottles B of beer is absorbed by the air, as ambient heat penetrates the outer and inner shells 17, 19 and insulation 21 of the merchandiser cabinet 11 and as the door 25 is opened to access the bottles. Eventually, when the program reaches low end temperature range decision block 157 (FIG. 8B), the measured temperature will have risen above −5.5° C. and the program will proceed at "D" to the cooling routine 115. However, the cooling routine will not be entered because the compressor flag has been set to HI when the compressor 29 was shut off so the program returns (at "C" in FIG. 8C) to block 123. Thus, the compressor 29 will not be turned on until the measured temperature exceeds the upper end of the set point temperature range. The operation of the cooling routine 115 is substantially the same when the temperature rises again above −2.5° C. It is noted that the frosting routine 117 will not be immediately entered when the compressor 29 is started again because the temperature protection −5° C. is on at the temperature of the product zone 13 will initially be in excess of that (block 151).

Once pulldown is achieved and the compressor 29 operates for a second time to cool the product zone 13 of the merchandiser 9, it is possible to enter the frosting routine 117. When the temperature drops below −5° C., the program proceeds at temperature protection decision block 151 (FIG. 8D) to make certain that the compressor 29 is running (block 163) and that pulldown has been achieved (block 155). The temperature protection block 163 prevents frosting from being initiated where the temperature in the refrigerate product zone 13 has risen rapidly or cannot be relatively constantly maintained. However, in the circumstances described, both of these conditions would be satisfied and the microcontroller 85 turns on the steam at block 165 by closing the circuit 101 for the heater 65 of the water vapor source 55. The temperature protection −5° C. will have been turned off at block 167 so subsequent the initiation, frosting may continue at temperatures in the product zone 13 above −5° C. It will be seen that once the temperature protection is turned off at block 167, the next time the program reaches temperature protection status decision block 169, the −5° C. temperature check steps (i.e., block 151) is skipped. Steam generated by the water vapor source 55 enters the merchandiser 9 for condensing on the bottles B as frost. The program cycles back via "B" to block 123 in the systems check routine 107.

Figure 8C:
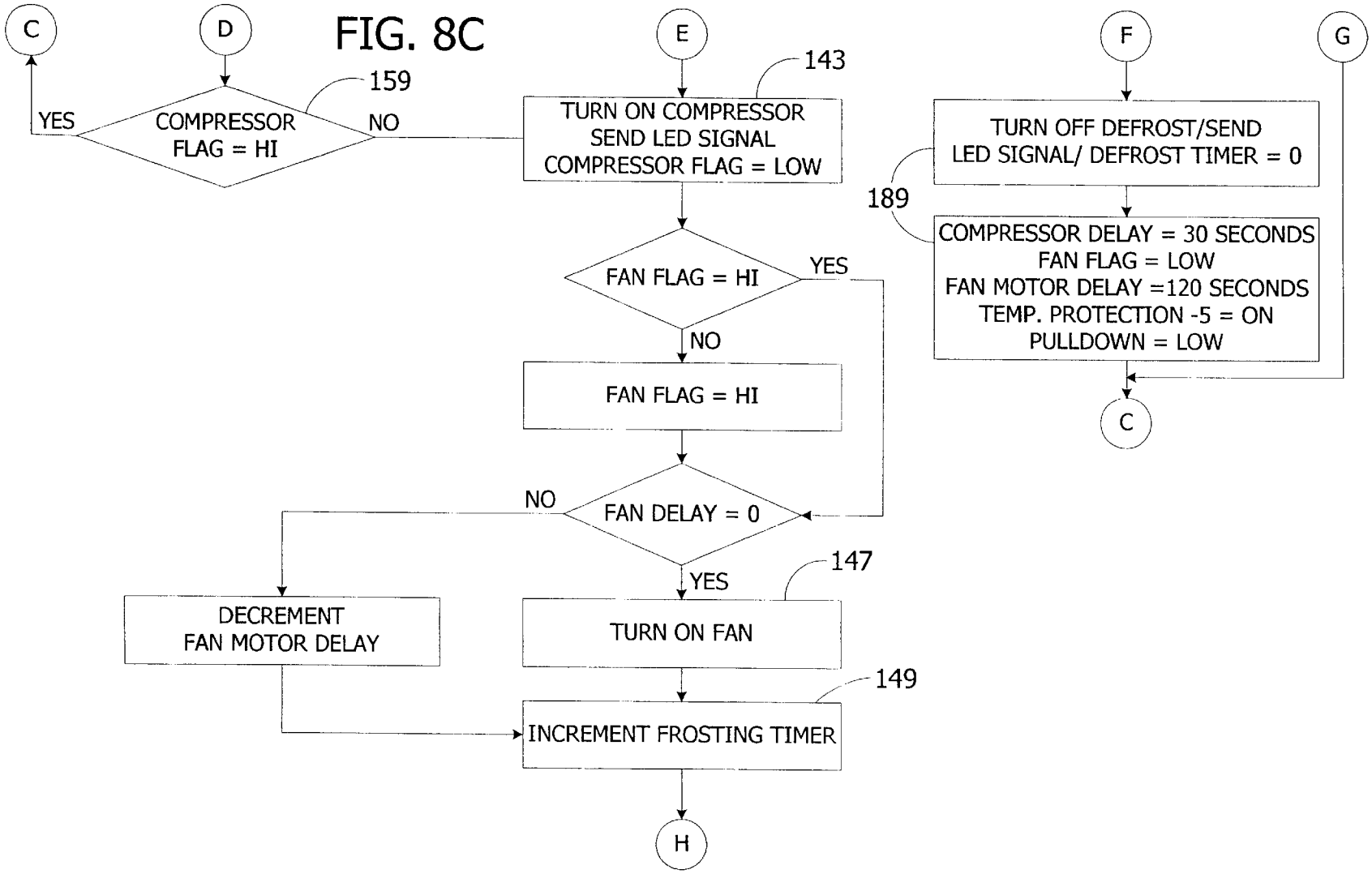
Figure 8D:
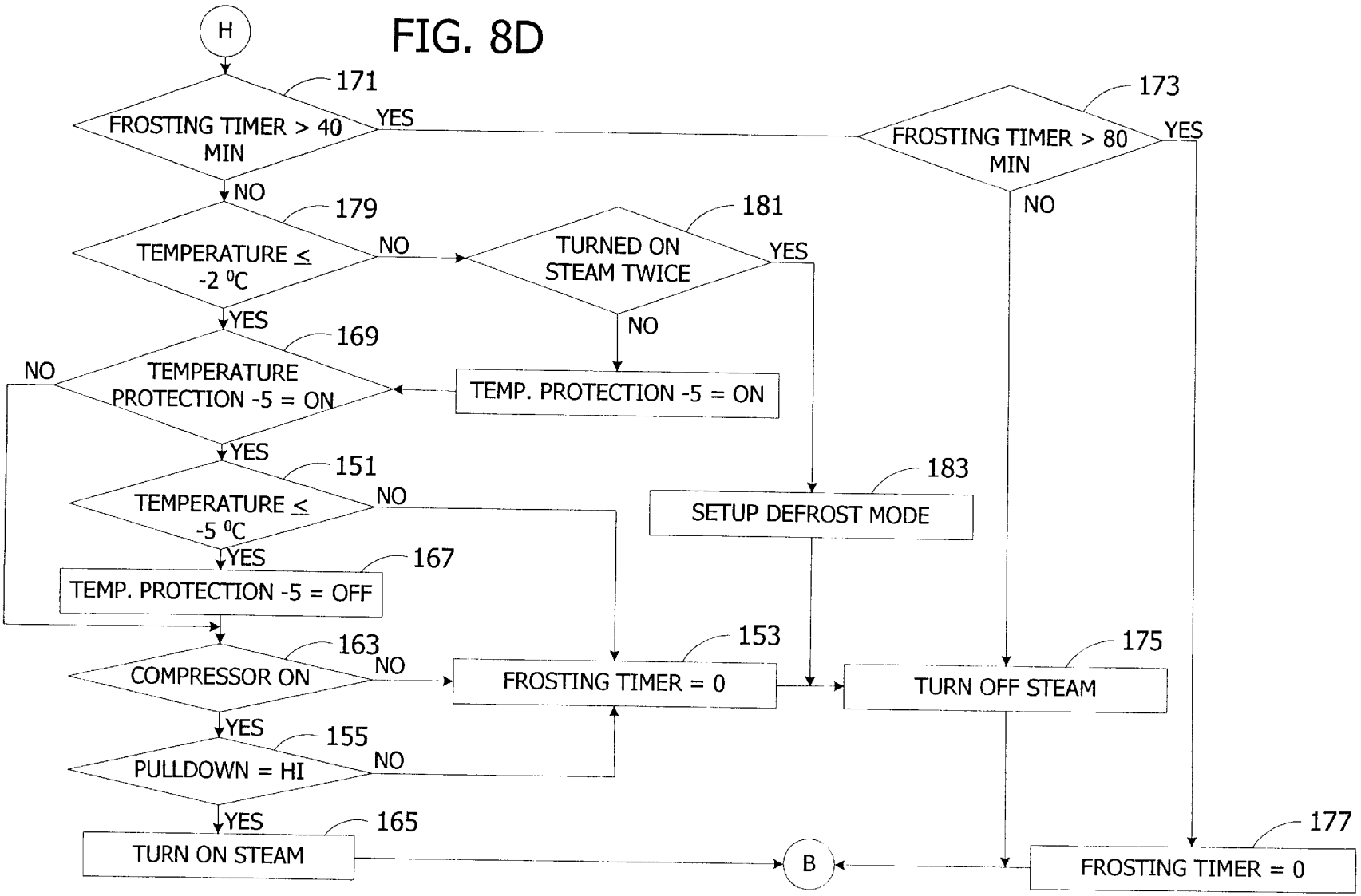

Under normal operating conditions, the program will cycle back to "H" in FIG. 8D, each time incrementing the frosting timer 118 at block 149 in FIG. 8C. Unless other terminating conditions (to be discussed) are met, the program will continue cycling in this manner so that the heater 65 continues to operate to generate steam for frosting the bottles B. The steam introduces heat into the refrigerated product zone 13 so that even though the compressor 29 is running, the temperature will ordinarily not go below the lower end of the set point temperature range (i.e., below −5.5° C.). It is noted that frosting will continue only so long as the compressor 29 is on (block 163). The size of the compressor 29 and set point temperature range are selected so that appropriate conditions for operation of frosting for a selected duration are most likely to occur in normal operation. Eventually when the program gets to a frosting timer decision block 171 (FIG. 8D), the frosting timer 118 will be greater than 40 minutes. The program then proceeds to decision block 173 where it is inquired whether the frosting timer 118 has exceeded 80 minutes. The times "40 minutes" and "80 minutes" were selected after testing the merchandiser 9 described, but could be other than these particular times without departing from the scope of the present invention. It will be understood that through these steps, frosting is operated (all other things being equal) on a 40 minutes on and 40 minutes off basis. Limiting operation in this manner helps to prevent the evaporator 33 and fan 45 from becoming iced too rapidly in the presence of the additional moisture supplied by the water vapor source 55. However, operation of the water vapor source 55 is sufficient to keep the bottles B frosted.

In any event, the answer to the query at decision block 173 will initially be "no" as the frosting timer 118 will not have been incremented to 80 minutes. The microcontroller 85 then turns off the heater 65 at function block 175 so that steam is not generated. The program will continue to operate to cool the product zone 13 on demand as described above. However, frosting will not be activated because the frosting timer is greater than 40 minutes and less than or equal to 80 minutes. When the frosting timer reaches a value greater than 80 minutes, the program at block 177 resets the frosting timer to zero, which will again allow frosting to occur upon satisfaction of the other conditions previously described.

Under certain conditions frosting will be terminated prior to the frosting timer 118 reaching 40 minutes. Each time the program cycles through the frosting routine 117 an inquiry is made at decision block 179 whether the temperature in the product zone 13 of the merchandiser 9 is less than or equal to −2° C. As with all of the temperatures and time periods, this value is believed to be optimal for the particular case and product (beer bottles B), but may be other than described without departing from the scope of the present invention. If the temperature is greater than −2° C., the program inquires at block 181 whether the steam has been turned on twice. In other words has the microcontroller 85 recorded the heater 65 being turned on, then being turned off and thence being turned on again. If frosting has been initiated only once, the program turns the temperature protection 5° C. back on (it will have been turned off at block when the steam is turned on). This will cause the microcontroller 85, by operation of decision block 151 and function block 175 to turn off the steam (or will prevent the steam from being turned on if frosting has not yet been initiated). Thus, if the temperature in the merchandiser 9 gets two degrees above the set point temperature while frosting is ongoing, frosting will be terminated. The heater 65 of the water vapor source 55 cannot be turned on again until the temperature in the product zone 13 again falls below −5° C. while the compressor 29 is running.

However at block 181 if the steam has been turned on twice, the microcontroller 85 will be put into the defrost mode at block 183 and the heater 65 will be de-energized to stop the flow of steam into the merchandiser 9. When the program cycles back around to the system checks routine 107 (block 123), the existence of the defrost mode is detected at block 135 (FIG. 8B) and the microcontroller 85 puts the merchandiser 9 into defrost, the operation of which is to be described. If the temperature in the merchandiser 9 is above −2° C. after the merchandiser has been operating a sufficiently long time for the steam to have been turned on twice, this indicates that the evaporator 33 has probably iced to the point where cooling is materially affected. For this reason, the program causes the microcontroller 85 to begin a defrost of the evaporator 33.

Referring now to FIGS. 8B and 8C, the operation of the defrost routine 111 will be more specifically described. As mentioned previously, defrost may be initiated at decision block 135 if the microcontroller 85 detects that the defrost mode is present under non-standard conditions, such as when the evaporator 33 has iced prematurely or defrost is remotely activated. If no unusual conditions exist, defrost will be initiated on the preset time cycle, such as every four hours. At decision block 137, the program compares the refrigeration cycle timer against the four hour time limit. If the refrigeration cycle timer is greater than four hours, the program first checks if pulldown at decision block 185 has been achieved (i.e., pulldown=HI). If not, the refrigeration cycle timer is reset to zero and no defrost occurs.

Assuming pulldown has been achieved (or that the program detected the defrost mode at block 135), the program asks at block 187 whether the conditions of the temperature of the product zone 13 being in excess of 20° C. and the defrost timer being less than 20 minutes are both satisfied. Upon first entering defrost, the answer will be "yes" so that defrost is then initiated by turning on the defrost heaters 47, 49, turning off the compressor 29 and fan 45 and causing a portion of the LED display 86 to hold in a constantly on position. The defrost timer is incremented and the program returns to the system checks routine 107. Unless defrost is terminated by a signal from the remote control, the program will continue to move through the defrost routine 111 in the manner described until the temperature in the product zone 13 exceeds 20° C. or the defrost timer exceeds 20 minutes. The provision of a temperature termination of defrost protects the bottles B from exposure to temperatures which would rapidly melt the frost on the bottles.

When the defrost timer reaches or exceeds 20 minutes or the product zone temperature reaches or exceeds 20° C., the answer at decision block 187 in the defrost routine 111 will be "no". At this time the program proceeds through "F" to blocks 189, the defrost heaters 47, 49 are turned off, the portion of the LED display 86 is turned off and the defrost timer is reset to zero. In addition, the pulldown is set to LOW and temperature protection −5° C. is turned on. Thus, in order for frosting to be activated after defrost has occurred, pulldown will have to be achieved and the temperature in the product zone 13 will need to be less than −5° C., in the same way as when the merchandiser 9 was first turned on. Thus, the refrigerated condition of the product zone 13 is allowed to be substantially stabilized before warm steam is again introduced. Importantly, compressor and fan delays of 30 seconds and 120 seconds, respectively, are set. The difference in delay times is provided to protect the frost on the bottles B from exposure to warm air circulating through the product zone 13. At the end of defrost, the evaporator 33 will be relatively warm. The temperature of the product zone 13 will be such that cooling will almost certainly be demanded at decision block 141 and the compressor 29 will be turned on (after the 30 second delay). However, if the fan 45 were allowed to come on simultaneously with the compressor 29 it would be circulating air over a still warm evaporator 33, causing the air to be warmed rather than cooled. Instead, the compressor 29 is allowed to operate for 90 seconds during which time the evaporator 33 becomes cold again. Only then is the fan 45 permitted to turn on (decision block 145) for circulating air over the evaporator 33 and through the product zone 13.

Thus it may be seen that the several objects are achieved and other advantageous results attained by the present invention. The merchandiser 9 protects its electrical components (particularly compressor 29) against damage caused by improper power supply voltage. The merchandiser 9 provides moisture to create and maintain frost on products held in the merchandiser. The merchandiser 9 is controlled to protect the frost by limiting defrost time and inhibiting circulation of warm air. Moreover, icing is minimized by limiting the time steam is introduced into the merchandiser 9 and also be providing for termination of the steam under conditions which indicate icing may be occurring.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A cooler for cooling articles and maintaining frost on the articles, the cooler comprising:

an insulated cabinet defining a product zone for holding the articles to be cooled;

a cooling coil constructed and arranged for receiving coolant therethrough to remove heat from the product zone in the cabinet;

a fan for circulating air over the cooling coil and through the product zone in the cabinet;

a water vapor source in fluid communication with the product zone for delivering water vapor to the product zone for condensing on the articles;

a controller to control flow of coolant through the cooling coil, operation of the fan, and operation of the water vapor source to deliver water vapor into the product zone for condensing on the articles as frost, the controller being configured to automatically conduct a defrost of the cooling coil, in which the cooling coil temperature increases to melt any frost thereon, and to restart cooling of the cooling coil by flow of coolant therethrough after defrost, the controller delaying operation of the fan after restarting the cooling of the cooling coil following defrost until the cooling coil has reached a temperature so that circulation of air from the cooling coil though the product zone will not melt frost on the articles.

2. A cooler as set forth in claim 1 wherein the controller is configured to delay operation of the fan for at least about 90 seconds after the cooling coil begins to be cooled following defrost.

3. A cooler as set forth in claim 1 further comprising a door mounted on the cabinet for opening to permit access to articles in the product zone within the cabinet and closing to close the product zone, the controller being operable to shut off the fan when the door is open.

4. A cooler as set forth in claim 1 wherein the controller is configured to prevent operation of the water vapor source until after the product zone has been cooled to a pulldown temperature.

5. A cooler as set forth in claim 4 wherein the controller is configured to prevent operation of the water vapor source unless a minimum frosting initiation temperature is detected in the cabinet.

6. A cooler as set forth in claim 5 wherein the controller is configured to disable operation of the water vapor source if the product zone temperature exceeds a maximum frosting temperature.

7. A cooler as set forth in claim 6 wherein the controller is configured to initiate defrost if the water vapor source has been activated and the product zone temperature exceeds the maximum frosting temperature.

8. A cooler as set forth in claim 7 wherein the controller is configured to initiate defrost only if the water vapor source has been activated to deliver water vapor to the product zone at least two times and the product zone temperature exceeds the maximum frosting temperature.

9. A cooler as set forth in claim 1 further comprising a compressor constructed and arranged in the cabinet for circulating coolant through the cooling coil, operation of the compressor being controlled by the controller.

10. A cooler as set forth in claim 9 wherein the controller is configured to operate the compressor at all times the water vapor source is operating to deliver water vapor to the product zone.

11. A cooler as set forth in claim 10 wherein the controller is configured to activate the water vapor source for a frosting period, and thence to de-activate the water vapor source for a non-frosting period.

12. A cooler as set forth in claim 11 wherein the frost period and the non-frosting period are each about 40 minutes.

13. A cooler as set forth in claim 1 wherein the water vapor source comprises a container for holding liquid water, a heater for heating the water to form a vapor, and piping extending from the container to the cabinet for introducing water vapor into the product zone.

14. A cooler as set forth in claim 13 wherein the piping includes an outlet and a generally straight pipe section extending generally transversely of the cabinet and inclining toward the outlet.

15. A cooler as set forth in claim 14 wherein the outlet of the piping is located downstream from the cooling coil and the fan.

16. A cooler as set forth in claim 15 wherein the water vapor is drawn into the cabinet solely by convection and the flow of air from the fan past the outlet.

17. A cooler as set forth in claim 14 wherein the cabinet includes an outer shell and insulation within the shell and between the product zone and the shell, and wherein the container is located on an exterior of the cabinet, the piping extending at least partially through the shell and within the insulation.

18. A cooler as set forth in claim 1 further comprising a pan for capturing liquid moisture from the cooling coil and a heater for heating the cooling coil pan to inhibit the formation of ice.

19. A cooler for cooling articles and maintaining frost on the articles, the cooler comprising:

a cabinet defining a product zone for holding the articles to be cooled;

a cooling coil constructed and arranged for receiving coolant therethrough to remove heat from the product zone in the cabinet;

a fan for circulating air over the cooling coil and through the product zone in the cabinet;

a water vapor source in fluid communication with the product zone for delivering water vapor to the product zone for condensing on the articles;

a controller to control flow of coolant through the cooling coil, operation of the fan, and operation of the water vapor source to deliver water vapor into the cabinet for condensing on the articles as frost, the controller being configured to prevent operation of the water vapor source until after the product zone has been cooled to a pulldown temperature.

20. A cooler for cooling articles and maintaining frost on the articles, the cooler comprising:

a cabinet having insulated walls defining a product zone for holding the articles to be cooled;

a cooling coil constructed and arranged for receiving coolant therethrough to remove heat from the product zone in the cabinet;

a fan for circulating air over the cooling coil and through the product zone in the cabinet;

a water vapor source in fluid communication with the product zone for delivering water vapor to the product zone for condensing on the articles, the water vapor source comprising a heater for heating water to form a vapor, and piping extending from the heater at least partially within the insulated wall of the cabinet and having an outlet opening inside the cabinet;

a controller to control flow of coolant through the cooling coil, operation of the fan, and operation of the water vapor source to deliver water vapor into the cabinet for condensing on the articles as frost.

21. A cooler for cooling articles and maintaining frost on the articles, the cooler comprising:

a cabinet having insulated walls defining a product zone for holding the articles to be cooled;

a cooling coil constructed and arranged for receiving coolant therethrough to remove heat from the product zone in the cabinet;

a fan for circulating air over the cooling coil and through the product zone in the cabinet;

a water vapor source in fluid communication with the product zone for delivering water vapor to the product zone for condensing on the articles, the water vapor source comprising a heater for heating water to form a vapor, and piping extending from the heater and having an outlet opening inside the cabinet, the outlet being located downstream from the cooling coil and fan within the flow of air circulated by the fan.

22. A cooler for holding and cooling articles comprising a cabinet defining a cooled area in which articles can be held, a cooling coil disposed for cooling the cooled area, a fan for circulating air over the cooling coil and through the cooled area, a compressor for compressing refrigerant, a condenser for removing heat from compressed refrigerant, a control for controlling operation of the compressor, a temperature sensor for detecting the temperature of the cooled area of the cabinet, a voltage sensor for detecting voltage of a power source to which the merchandiser can be connected, the control being configured to operate in a normal mode to turn on and off the compressor in response to the temperature of the cooled area detected by the temperature sensor and to operate in an override mode to prevent the compressor from being turned on when the voltage sensor detects that the voltage of the power source is below a predetermined minimum start voltage.

23. A cooler as set forth in claim 22 wherein the control is configured to prevent the compressor from being turned on in response to detected temperature of the cooled area if less than a preset amount of time has passed since the last time the compressor was on or the last time the cooler was connected to the power source.

24. A cooler as set forth in claim 23 wherein the control is configured to turn off the compressor if the voltage drops below the minimum start voltage.

25. A cooler as set forth in claim 22 wherein the control is configured to initiate a defrost cycle and configured to terminate the defrost cycle when either a predetermined defrost time has elapsed or the temperature measured by the sensor in the cooled area rises to a predetermined temperature.

26. A cooler as set forth in claim 22 further comprising a remote control, and a receiver capable of receiving a signal from the remote control and communicating with the control to override normal operation of the control.

27. A cooler as set forth in claim 26 wherein the control is configured to initiate defrost if not already in defrost and to terminate defrost if in defrost.

* * * * *